United States Patent [19]

Fradin

[11] 4,205,941

[45] Jun. 3, 1980

[54] METHODS AND APPARATUSES FOR AVOIDING SURGING PHENOMENA IN COMPRESSORS

[75] Inventor: Christian F. Fradin, Bures-sur-Yvette, France

[73] Assignee: Office National d'Etudes et de Recherches Aerospatiales (O.N.E.R.A.), Chatillon-sous-Bagneux, France

[21] Appl. No.: 902,166

[22] Filed: May 2, 1978

[30] Foreign Application Priority Data

May 16, 1977 [FR] France ..... 77 14937

[51] Int. Cl.[2] ..... F01B 25/02; F01D 17/08; F04D 27/02

[52] U.S. Cl. ..... 415/1; 415/20; 415/49

[58] Field of Search ..... 415/1, 13, 17, 20, 26–29, 415/47, 49

[56] References Cited

U.S. PATENT DOCUMENTS

| | | | |
|---|---|---|---|
| 2,470,565 | 5/1949 | Loss | 415/27 |
| 2,696,345 | 12/1954 | Hopper | 415/1 |
| 3,292,845 | 12/1966 | Hens et al. | 415/1 |
| 3,901,620 | 8/1975 | Boyce | 415/1 |

FOREIGN PATENT DOCUMENTS

| | | | |
|---|---|---|---|
| 822084 | 10/1959 | United Kingdom | 415/26 |

*Primary Examiner*—John J. Vrablik

*Attorney, Agent, or Firm*—Larson, Taylor and Hinds

[57] ABSTRACT

The invention relates to a centrifugal compressor comprising an impeller but not comprising distributor blading upstream of the impeller, a pressure probe and regulator means controlled by the probe and arranged to act on the flow conditions downstream or upstream of the compressor to avoid the risk of surging. The probe is disposed upstream of the impeller of the compressor and being arranged to detect the critical direction of the absolute velocity of the fluid and to measure the critical value of the radial gradient of the static pressure beyond which the compressor runs the risk of being subjected to surging. The said probe is provided with directional pressure ports, situated at the same distance from the wall of the intake casing and disposed symmetrically with respect to the critical direction of the absolute velocity of the fluid beyond which a risk of surging exists, and radial pressure gradient ports, situated one nearer to the said wall and the other farther from the said wall (with respect to the two directional pressure inlets).

8 Claims, 8 Drawing Figures

METHODS AND APPARATUSES FOR AVOIDING SURGING PHENOMENA IN COMPRESSORS

The invention relates to a method and apparatus for avoiding surging in centrifugal compressors which do not comprise distributor blading upstream of the impeller.

Hitherto, known methods and apparatus relied upon the detection of the pressure downstream of the impeller of the compressor. Now the flow downstream of the impeller of the compressor is at a high temperature as a result of the compression and this complicates the implementation and setting in operation of the apparatus and methods using the known technique involving detection of the downstream pressure.

The present invention, which results from the study of the flow of fluids in a centrifugal compressor, undertaken by the applicants, has the object of remedying these drawbacks.

According to the present invention there is provided a method of avoiding surging in a centrifugal compressor comprising an impeller but not comprising distributor blading upstream of the impeller, the said method consisting in acting on regulator means to modify the flow conditions upstream or downstream of the compressor with the aim of making the risk of surging disappear, the said method comprising the steps of detecting the direction of the absolute velocity of the fluid upstream of the impeller of the compressor, comparing this direction with a predetermined critical direction which depends on the characteristics of the compressor and beyond which the direction reveals a risk of surging, measuring the value of the radial gradient of the static pressure of the fluid upstream of the impeller of the compressor, comparing this value with a predetermined critical value beyond which the said radial pressure gradient reveals a risk of surging, and using the results of these comparisons to act on the regulator means.

Also according to the invention there is provided a centrifugal compressor comprising an impeller but not comprising distributor blading upstream of the impeller, a pressure probe and regulator means controlled by the probe and arranged to act on the flow conditions downstream or upstream of the compressor to avoid the risk of surging, the probe being disposed upstream of the impeller of the compressor and being arranged to detect the critical direction of the absolute velocity of the fluid and to measure the critical value of the radial gradient of the static pressure beyond which the compressor runs the risk of being subjected to surging, the said probe being provided with directional pressure ports, situated at the same distance from the wall of the intake casing and disposed symmetrically with respect to the critical direction of the absolute velocity of the fluid beyond which a risk of surging exists, and radial pressure gradient ports, situated one nearer to the said wall and the other farther from the said wall (with respect to the two directional pressure inlets).

Advantageously, the detection of the direction of the absolute velocity of the fluid and the measurement of the value of the radial gradient of the static pressure take place at a distance from the impeller of the compressor which is between 0.05R and 0.5R, R designating the radius of the intake casing.

Means for measuring and processing the data transmitted by the pressure ports and provided for comparing the values supplied by the two directional pressure ports and by the two radial pressure gradient ports. These means for measuring and processing the data control regulator means utilise the comparison between the two directional pressure ports and between the two radial pressure gradient ports, so that, when this comparison indicates a risk of surging the regulator means act on the flow conditions downstream and/or upstream of the compressor to make this risk of surging disappear.

The invention will now be further described by way of example in more detail with reference to the accompanying drawings, in which.

Figure 1:
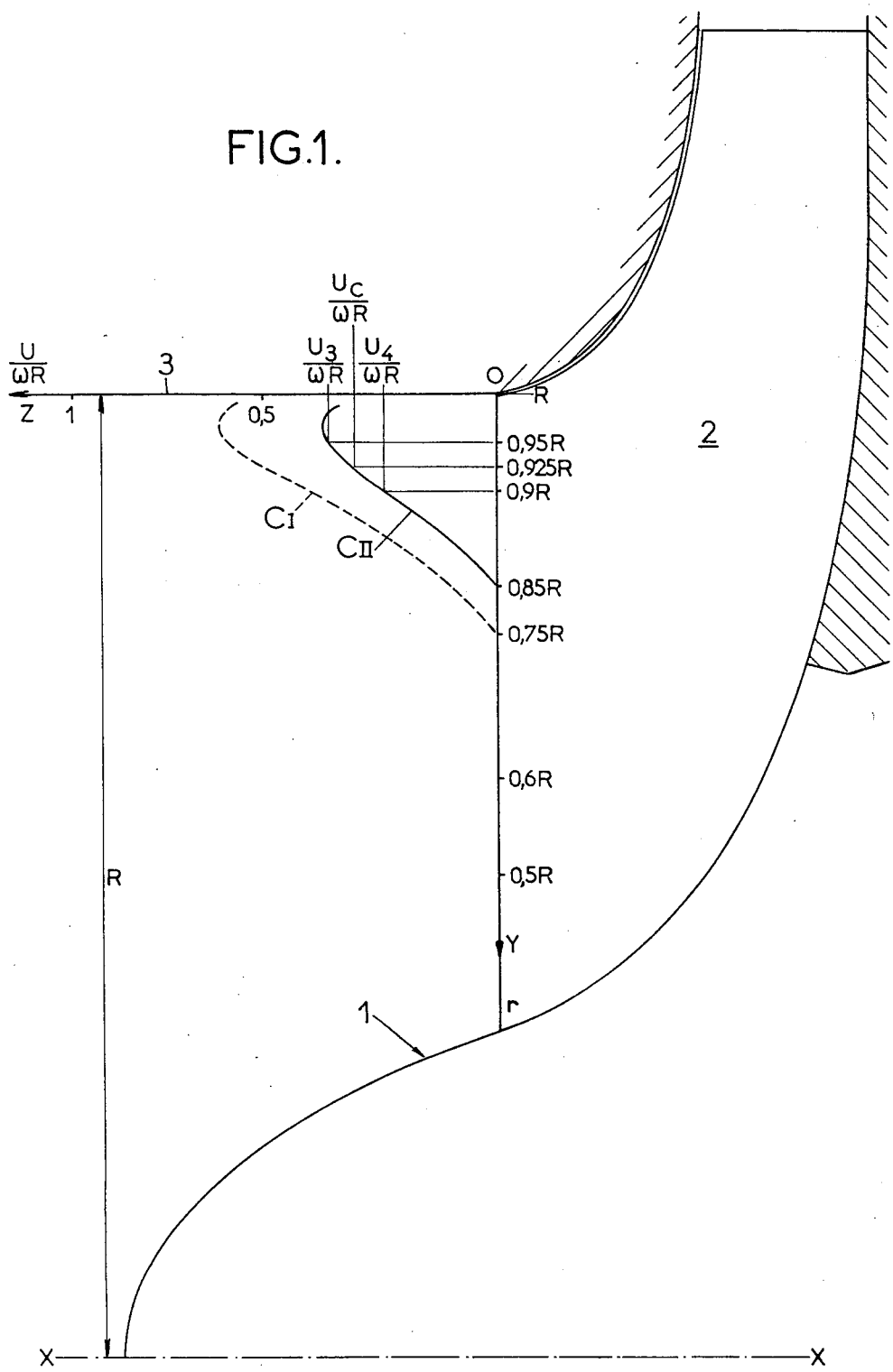
FIG. 1 shows half of a diagrammatic axial section of part of a conventional centrifugal compressor.

In FIG. 1 there is shown diagrammatically in half view the impeller 1, having blades 2, of a centrifugal compressor without upstream distributor blading upstream of the impeller. The compressor has an intake casing 3.

The work done by the applicants in the study of the flow of fluids in a centrifugal compressor without upstream distributor blading has shown that, in the conditions of operation below the surging curve, the flow of fluid immediately upstream up the impeller is without tangential component. Moreover, when the conditions of operation approach the surging curve, a tangential component to the velocity appears, this tangential component being progressively greater at positions closer to the walls of the intake casing 3 (near to the phenomenon of boundary layer).

In FIG. 1 the evolution of this tangential component U, relative to $\omega R$, is represented, $\omega$ designating the angular velocity of the impeller in radians per second, and R the outer radius of the inlet of the impeller 1 which corresponds at close clearance to the radius of the intake casing 3.

The values of $U/\omega R$ are shown on the axis O-Z (parallel to this axis X—X of the compressor) and the values of the local radius r, referred to the radius R, on the axis O-Y (perpendicular to the axis X—X of the compressor).

The curve $C_I$, represented by a dotted line, shows the evolution of the critical tangential component in the neighbourhood of the surging of the compressor.

The curve $C_{II}$, represented in full line, shows the evolution of the critical tangential component $U_c$ beyond which the invention requires the compressor not to operate.

Figure 2:
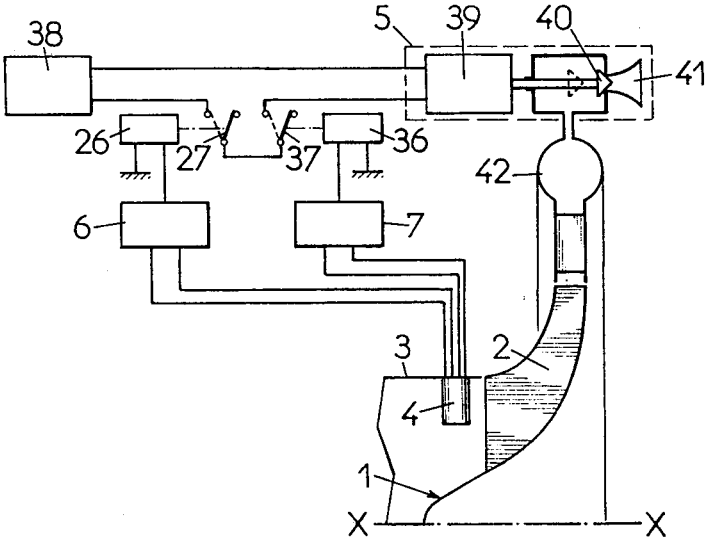
FIG. 2 shows diagrammatically half a centrifugal compressor (on a smaller scale than FIG. 1) with apparatus according to the invention for detecting phenomena which precede surging of the centrifugal compressor.

The apparatus shown in FIG. 2 is used to prevent the compressor from being operated beyond this critical limit. This apparatus comprises a probe 4 and regulator means 5. The probe 4 is disposed upstream of the compressor and is arranged to detect the critical direction of the absolute velocity of the fluid and to measure the critical value of the radial gradient of the static pressure beyond which the compressor risks being subjected to surging. The regulator means 5 is controlled by the probe 4 in such a manner that, as soon as the critical values of the direction of the absolute velocity of the fluid and of the measure of the radial gradient of the static pressure are reached, these regulator means act on the conditions downstream or upstream of the compressor to make the risk of surging disappear.

When a centrifugal compressor without upstream distributor blading is concerned, the probe is disposed upstream of the impeller at a distance of between 0.05R and 0.5R, R designating the radius of the intake casing 3 of the compressor.

Figure 3:
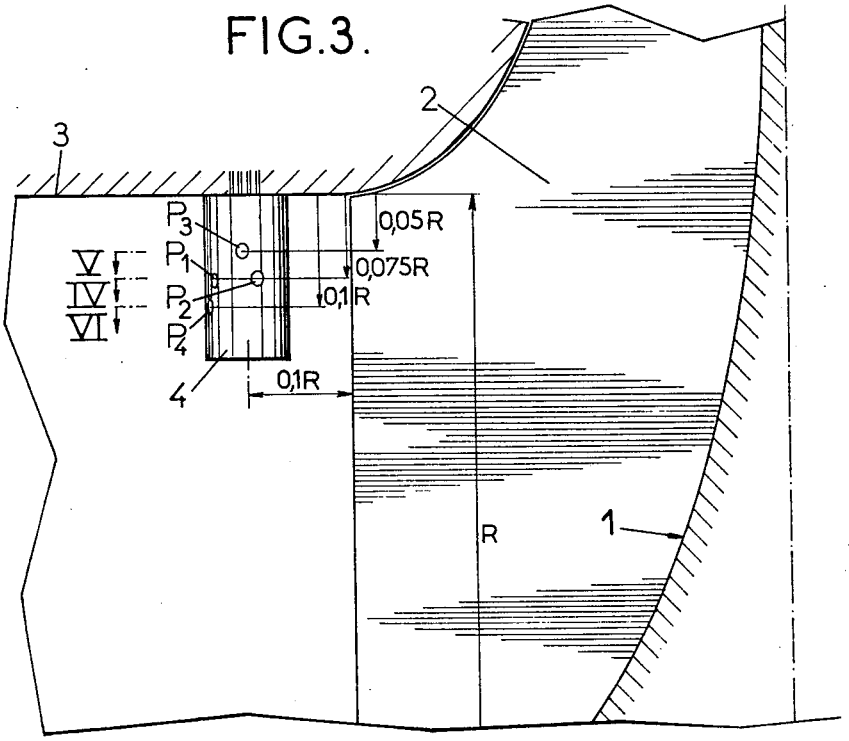
FIG. 3 is a view on a larger scale of a detail of FIG. 2.
Figure 4:
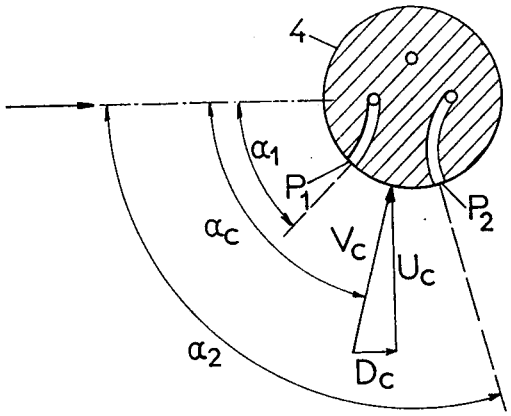
FIGS. 4, 5 and 6 are sections on a further enlarged scale taken on the lines IV, V and VI of FIG. 3.

As shown on a larger scale in FIG. 3, in which the same reference numerals designate the same members as in FIG. 2, the probe has two directional pressure ports $P_1$ and $P_2$ and two static pressure ports $P_3$ and $P_4$. The two directional pressure ports $P_1$ and $P_2$ are situated at the same distance from the wall of the intake casing 3 (FIG. 4) and are disposed symmetrically with respect to the critical direction $V_c$ of the absolute velocity of the fluid beyond which there exists a risk of surging.

Figure 5:
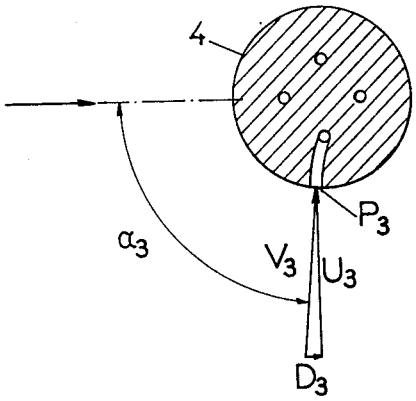
Figure 6:
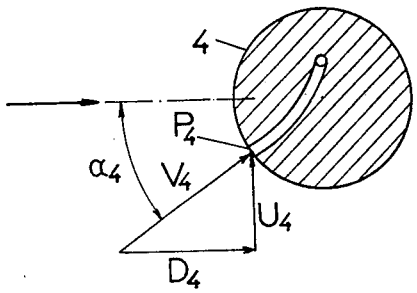

The two radial static pressure gradient ports are situated one, $P_3$, nearer to the said wall and the other, $P_4$, further from the said wall (with respect to the two directional pressure ports $P_1$ and $P_2$), each of these two radial pressure gradient ports $P_3$ or $P_4$ being disposed at a respective angle $\alpha_3$, $\alpha_4$ which the absolute velocity $V_3$ or $V_4$ makes with its axial component $D_3$ or $D_4$ at the distance considered from the wall and with account taken of the values of the tangential component $U_3$ or $U_4$ and of the axial component $D_3$ or $D_4$ at this distance (FIGS. 5 and 6).

The probe 4 is, as shown, preferably cylindrical so as to present a minimum drag whatever the direction of the fluid may be.

In one embodiment the cylindrical probe 4, the distances $h_1$, $h_2$, $h_3$, $h_4$ from the wall and the angles $\alpha_1$, $\alpha_2$, $\alpha_3$, $\alpha_4$ of the pressure ports $P_1$, $P_2$, $P_3$, $P_4$ have respectively the values:

| | |
|---|---|
| $h_1 = 0.075R$ | $\alpha_1 = 45°$ |
| $h_2 = 0.075R$ | $\alpha_2 = 105°$ |
| $h_3 = 0.05R$ | $\alpha_3 = 90°$ |
| $h_4 = 0.1R$ | $\alpha_4 = 30°$ |

Measurement means 6 and 7 (FIG. 2) are then provided for comparing the values supplied by the two directional pressure ports $P_1$ and $P_2$ and by the two radial pressure gradient ports $P_3$ and $P_4$.

These measurment means 6 and 7 control the regulator means 5 which use the comparison, on the one hand, between the two directional pressure ports $P_1$ and $P_2$ and, on the other hand, between the two radial pressure gradient ports $P_3$ and $P_4$, so that, when this comparison indicates a risk of surging, the regulator means 5 act on the conditions downstream of the compressor to make this risk of surging disappear.

Figure 7:
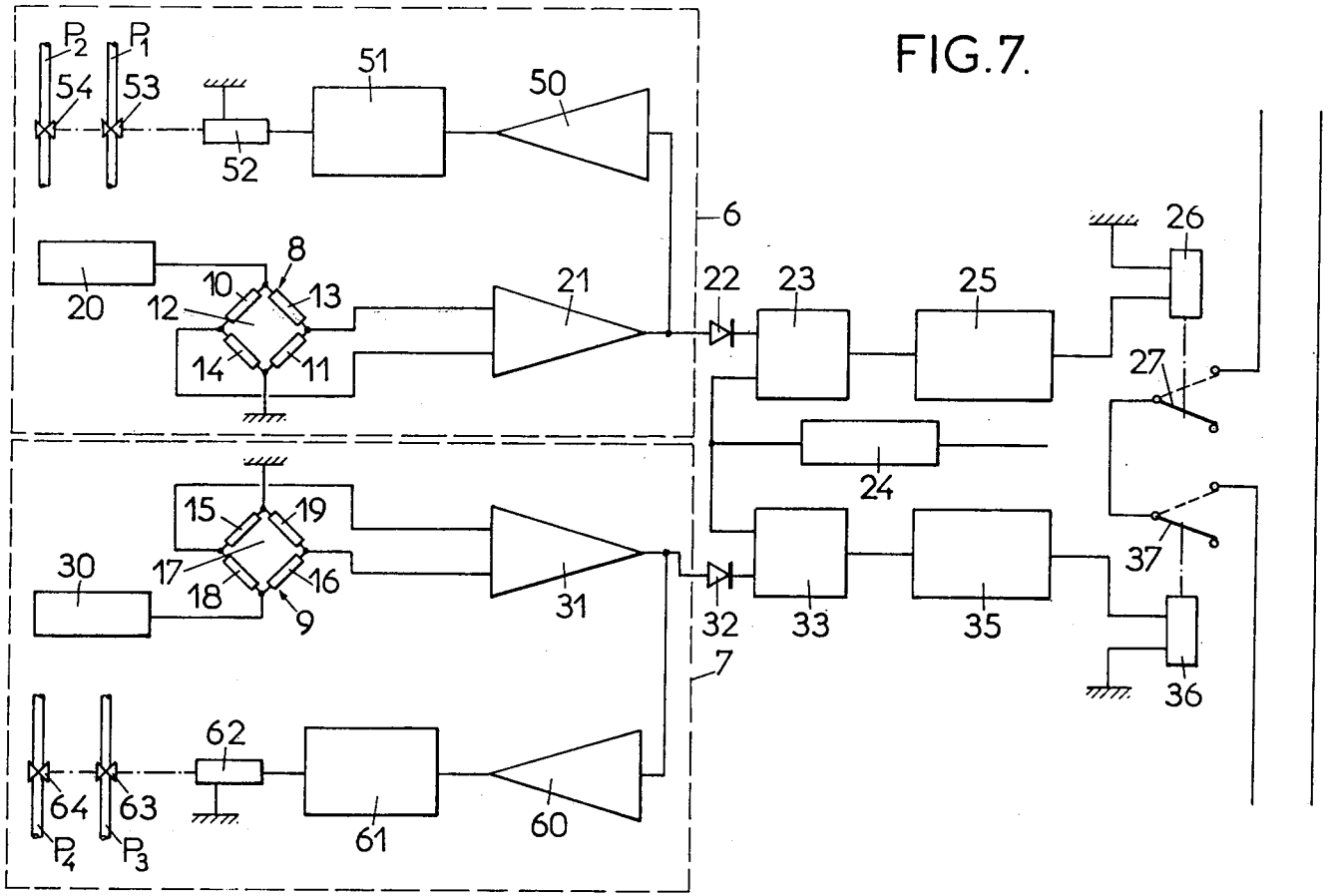
FIG. 7 shows a preferred embodiment of the circuit diagram of the apparatus shown in FIG. 2.

The measurement means 6 and 7 comprise differential pressure pick-ups 8 and 9, not represented as far as their mechanical structure is concerned, but diagrammatically in FIG. 7 as far as their electrical structure is concerned.

The differential pressure pick-up 8 comprises two strain gauges 10 and 11, and a membrane subjected, at one side, to the directional pressure at the port $P_1$ and, at the other side, to the directional pressure at the port $P_2$. These two gauges 10 and 11 are connected in a bridge system 12 with two balancing resistances 13 and 14.

The differential pressure pick-up 9 comprises two strain gauges 15 and 16, and a membrane subjected at one side, to the pressure at the port $P_3$ and to the pressure at the port $P_4$. The gauges 15 and 16 are connected in a bridge system 17 with two balancing resistances 18 and 19.

The bridge 12 is fed by a voltage source 20 and the difference in voltage at the terminals of the bridge 12 is fed to an amplifier 21. The output of this amplifier 21 is fed into a divider 23 through a diode 22 which prevents transmission of the whole signal due to an inversion of the pressure in the intake casing of the compressor.

This divider 23 receives also a signal $k\omega^2$ proportional to the square of the angular velocity of the impeller of the compressor, and operated on in a multiplier 24 which itself receives the signal $k\omega$ resulting from means not shown for measuring the angular velocity of the impeller.

The divider 23 therefore delivers a signal proportional to the difference in pressure between the ports $P_1$ and $P_2$, related to the square of the angular velocity $\omega$ of the moving impeller, which is introduced into an ON-OFF control device 25 whose output feeds a relay 26 controlling a switch 27.

The bride 17 is supplied by a voltage source 30 and the difference in voltage read at the terminals of the bridge 17 is fed into an amplifier 31. The output of this amplifier 31 is fed into a divider 33 through a diode 32 which prevents transmission of the whole signal due to an inversion of the pressure in the intake casing of the compressor.

This divider 33 receives also a signal $k\omega^2$ proportional to the square of the angular velocity of the impeller of the compressor, and operated upon in the multiplier 24 which itself receives the signal $k\omega$ resulting from means not shown for measuring the angular velocity of the impeller.

The divider 33 therefore delivers a signal proportional to the difference in pressure between the ports $P_3$ and $P_4$ relative to the square of the angular velocity $\omega$ of the moving impeller, which is introduced into an ON-OFF control device 35 whose output feeds a relay 36 controlling a switch 37.

The two switches 27 and 37 are interposed between a current source 38 and a servo-motor 39 which controls the valve member 40 controlling an orifice 41 connected to the output 42 of the compressor (FIG. 2).

Figure 2A:
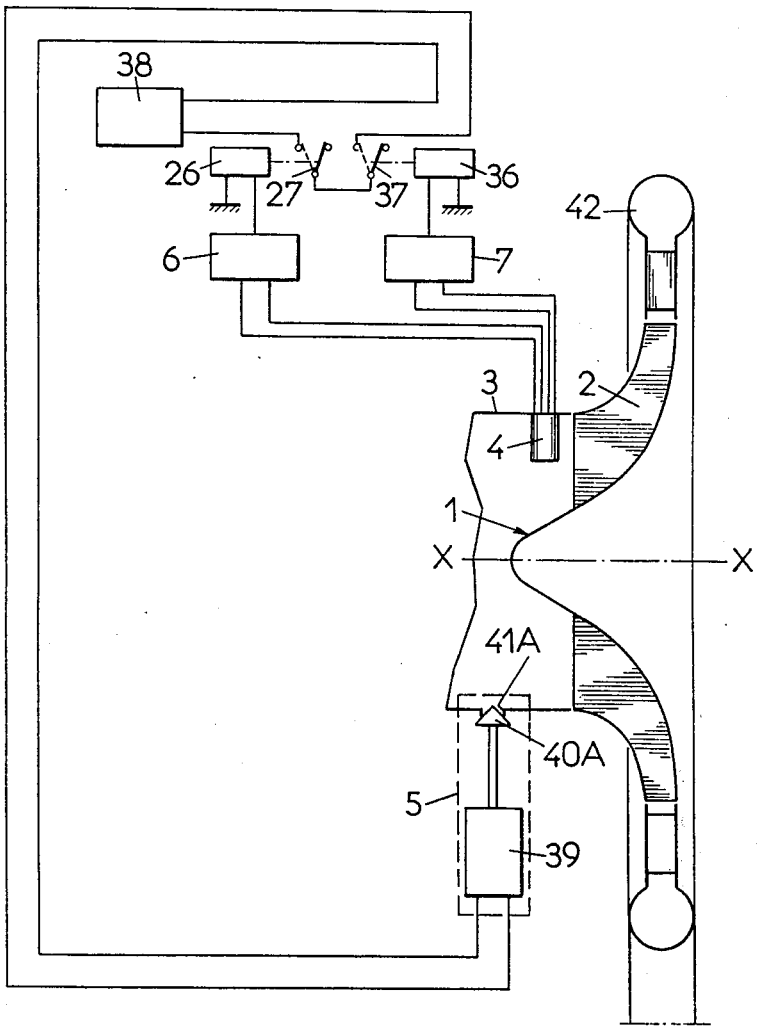
FIG. 2A shows an alternative of the centrifugal compressor shown in FIG. 2.

On the FIG. 2A, in which the same references show the same elements, the regulator means 5 are provided upstream. These upstream regulator means 5 comprise a valve member 40A cooperating with a by-pass orifice 41A provided in the intake casing 3 between the inner of said intake casing and the atmosphere. The servomotor 39 controls said valve member 40A.

In order to avoid the measuring means giving erroneous data in the case when the directional pressure ports $P_1$ or $P_2$ and/or the radial pressure gradient ports $P_3$ and $P_4$ have become accidentally blocked, provision is made for neutralising these pressure ports by making them include, in each of their connecting conduits with the corresponding differential pressure pick-ups, valves 53, 54 for the directional pressure ports $P_1$ and $P_2$ and 63 and 64 for the radial pressure gradient ports $P_3$ and $P_4$.

For this purpose the electrical signals delivered by the bridge 12 are amplified in an amplifier 50 whose output signal is introduced into an ON-OFF control device 51 whose output feeds a relay 52 controlling the valves 53 and 54.

Similarly, the electrical signals delivered by the bridge 17 are amplified in an amplifier 60 whose output signal is introduced into an ON-OFF control device 61 whose output feeds a relay 62 controlling the valves 63 and 64.

The angles between the axial direction and the axes of the directional pressure ports $P_1$ and $P_2$ are respectively equal to $\alpha$, and $\alpha_2$, so that $(\alpha_1+\alpha_2/2)$ is equal to the angle $a_c$ of the chosen critical velocity $V_c$.

At the approach of surging, the direction of the absolute velocity tends towards the direction of the critical absolute velocity $V_c$ and the difference $P_1-P_2$ (between the pressures at the ports $P_1$ and $P_2$) tends towards zero. The equality of the pressures $P_1$ and $P_2$ (at the ports $P_1$ and $P_2$) will therefore be indicative of the fact that the direction of the absolute velocity has reached its critical value $\alpha_c$. Conversely, in the safe condition, that is to say remote from the surging curve of the compressor, the difference $P_1-P_2$ will be significant.

At the approach of surging the difference $P_3-P_4$ will be significant whereas, conversely, the safe condition will be revealed by a small difference $P_3-P_4$, which may even be zero.

In the period of operation of the compressor far from its surging curve, different directional pressures $P_1$ and $P_2$ and equal or very close radial pressure gradients $P_3$ and $P_4$ are observed.

The switches 27 and 37 are then in the position shown in full lines (FIGS. 2 and 7); the valve member 40 is in its closed position as shown in full lines in FIG. 2.

When the surging curve is approached, equal or substantially equal values are observed for the directional pressures $P_1$ and $P_2$ and different values for the radial pressure gradients $P_3$ and $P_4$.

The switches 27 and 37 are then in the position shown in dotted lines in FIGS. 2 and 7; the valve member 40 is in its open position as shown in dotted lines in FIG. 2. The opening of this valve brings the compressor back towards operating conditions remote from its surging curve.

It has been assumed in the above description that the regulator means are so arranged that, as soon as the risk of surging is detected, the said regulator means act on the conditions downstream or upstream of the compressor to make the risk of surging disappear.

In a modification which is not illustrated, the switches 27 and 37 can be an interruption of the operation of the compressor.

Provision has also been made, in the case where the directional pressure inlets $P_1$ or $P_2$ and/or the radial pressure gradient inlets $P_3$ or $P_4$ become accidentally blocked, for neutralisation of these pressure inlets; in a modification, not illustrated, it will be possible, after having detected the blocking of these pressure inlets, to provide for an audible and/or visible warning.

It will be appreciated that the probe and associated apparatus are particularly simple and can be envisaged with a low manufacturing cost.

Moreover, the presence of a probe as simple as that described and illustrated in the intake casing of a compressor does not, in practice, introduce any inconvenience in using it.

I claim:

1. A method of avoiding surging in a centrifugal compressor comprising an impeller but not comprising distributor blading upstream of the impeller, the said method consisting in acting on regulator means to modify the flow conditions upstream or downstream of the compressor with the aim of making the risk of surging disappear, the said method comprising the steps of detecting the direction of the absolute velocity of the fluid upstream of the impeller of the compressor, comparing this direction with a predetermined critical direction which depends on the characteristics of the compressor and beyond which the said direction reveals a risk of surging, measuring the value of the radial gradient of the static pressure of the fluid upstream of the impeller of the compressor, comparing this value with a predetermined critical value beyond which the said radial pressure gradient reveals a risk of surging and using the results of these comparisons to act on the regulator means.

2. A method according to claim 1, wherein the detection of the direction of the absolute velocity of the fluid and the measurement of the radial gradient of the static pressure takes place at a distance from the impeller of the compressor which is between 0.05R and 0.5R, R designating the radius of the intake casing.

3. A centrifugal compressor comprising an impeller but not comprising distributor blading upstream of the impeller, a pressure probe and regulator means controlled by the probe and arranged to act on the flow conditions downstream or upstream of the compressor to avoid the risk of surging, the probe being disposed upstream of the impeller of the compressor and being arranged to detect the critical direction of the absolute velocity of the fluid and to measure the critical value of the radial gradient of the static pressure beyond which the compressor runs the risk of being subjected to surging, the said probe being provided with directional pressure ports, situated at the same distance from the wall of the intake casing and disposed symmetrically with respect to the critical direction of the absolute velocity of the fluid beyond which a risk of surging exists, and radial pressure gradient ports, situated one nearer to the said wall and the other farther from the said wall (with respect to the two directional pressure inlets).

4. A compressor according to claim 3, wherein each of the two radial pressure gradient inlets is disposed at the angle formed by the axis of the compressor and the critical direction of the absolute velocity of the fluid at the distance considered from the wall and with account taken of the values of the tangential component and the axial component at this distance.

5. A compressor according to claim 3 or 4, wherein the probe is disposed upstream of the impeller at a distance of between 0.05R and 0.5R, R designating the radius of the intake casing.

6. A compressor according to claim 5 and including measurement means for comparing the values supplied by the two directional pressure ports and by the two radial pressure gradient inlets.

7. A compressor according to claim 6, wherein the regulation means use the comparison between the pressures at the directional pressure ports and between the two radial pressure gradient ports in such a manner that when this comparison indicates a risk of surging these regulator means act on the conditions downstream or upstream of the compressor to make this risk of surging disappear.

8. A compressor according to claim 6 or 7, wherein the measurement means comprise two differential pressure pick-ups with strain gauges.

* * * * *